United States Patent [19]

Hehn et al.

[11] 4,303,330

[45] Dec. 1, 1981

[54] DEVICE FOR PROCESSING A PHOTOGRAPHIC FILM

[75] Inventors: Wilfried Hehn, Munich; Siegfried Kurths, Taufkirchen; Werner Sieber; Franz Kocourek, both of Munich, all of Fed. Rep. of Germany

[73] Assignee: AGFA-Gevaert Aktiengesellschaft, Leverkusen, Fed. Rep. of Germany

[21] Appl. No.: 210,765

[22] Filed: Nov. 26, 1980

[30] Foreign Application Priority Data

Dec. 21, 1979 [DE] Fed. Rep. of Germany ..... 2951847

[51] Int. Cl.[3] ..... G03D 5/00

[52] U.S. Cl. ..... 354/319; 134/69 P; 15/100

[58] Field of Search ..... 354/318, 319, 320, 321, 354/322, 297; 134/64 P, 122 P; 34/155; 15/100

[56] References Cited

U.S. PATENT DOCUMENTS 3,610,131 10/1971 Frick et al. ..... 134/122 P
3,616,742 11/1971 Boyle et al. ..... 134/64 P
4,023,190 5/1977 Fassler ..... 354/319
4,142,194 2/1979 Hamlin ..... 354/319
4,187,023 2/1980 Schausberger et al. ..... 134/64 P

FOREIGN PATENT DOCUMENTS 7145698 10/1972 Fed. Rep. of Germany .

*Primary Examiner*—L. T. Hix
*Assistant Examiner*—Alan Mathews
*Attorney, Agent, or Firm*—Michael J. Striker

[57] ABSTRACT

A device for processing a photographic film through a moistening chamber and a drying chamber has a transition zone where a pair of counterpositioned squeegee rollers is located, of which the upper roller contacts an emulsion carrying surface of the film and the lower roller engages the back surface of the film. The film is advanced to the transition zone from the moistening chamber by a pair of transporting rollers rotated with a predetermined speed. The lower squeegee roller is rotated with a speed exceeding the speed of rotation of the transporting rollers so that a predetermined tension is applied only to the back side of the film to avoid a potential damage to the emulsion carrying surface of the film.

10 Claims, 1 Drawing Figure

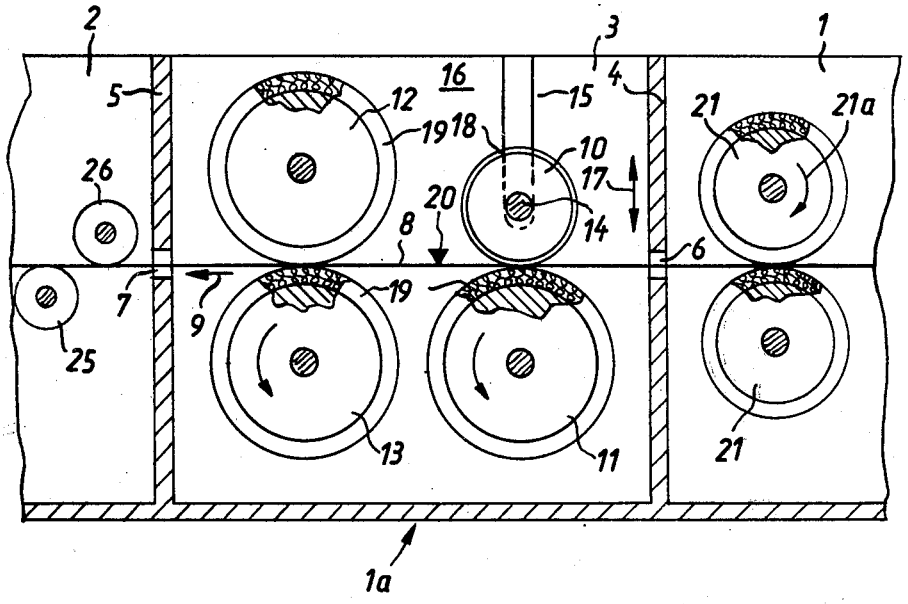
2
3
1
5
16
4
12
15
21
21a
19
18
10
26
17
20
14
8
6
7
9
19
25
13
11
21
1a

DEVICE FOR PROCESSING A PHOTOGRAPHIC FILM

BACKGROUND OF THE INVENTION

The present invention relates to film developing equipment and more particularly to a device for processing a photographic film where the film is to be dried.

The known devices of the foregoing type include a moistening chamber and a drying chamber and means for advancing a film from the moistening chamber to the drying chamber. The known film drying arrangement disclosed in German Gebrauchsmuster No. 7,145,698 has a pair of squeegee rollers which are adapted to squeeze a liquid adhering to an emulsion carrying upper surface of the film. Due to the various structural conditions inside and outside the moistening chamber films of relatively large width which are frequently processed in the known arrangements, are often, not properly conveyed in the direction of its advancement from the moistening chamber to the drying chamber. This improper transportation of the film in the majority of cases may occur in the transition zone between the moistening chamber and the squeegee rollers.

SUMMARY OF THE INVENTION

It is an object of the invention to provide an improved device for processing a photographic film.

Another object of the invention is to provide a device with improved film transporting means in a film developing arrangement.

Still another object of the invention is to provide such film transporting means in a film drying process in which the tension is applied to a film located in the moistening chamber by means of the squeegee rollers whereby the proper conveying of a film having a relatively large width is assured.

Yet another object of the invention is to provide a device in which the tension is applied to the insensitive back side of the film, whereby potential damage to emulsion-carrying surface is prevented, which damage might otherwise occur due to differential speeds of the squeegee rollers. The roller contacting the emulsion side rotates only at the instantaneous film speed and the driven roller which contacts the rear side of the film, can slip on this rear side (usually a polyester layer) if the film tension increases too much. As a result, only the predetermined film footage is advanced per unit time.

These and other objects of the invention are attained by a device for processing a photographic film of relatively large width and having an emulsion-carrying surface and back surface, comprising a housing including a moistening chamber and a drying chamber, transporting means located in said moistening chamber and adapted to advance said film toward said drying chamber, said transporting means having a pair of transporting rollers rotated with a predetermined speed, and a pair of counterpositioned squeegee rollers positioned between the moistening chamber and the drying chamber and adapted to squeeze moisture from the film, said squeegee rollers including an upper idling squeegee roller contacting said emulsion carrying surface and a driven lower squeegee roller contacting said back surface of the film, said lower squeegee roller having a speed of rotation exceeding said predetermined speed to apply a predetermined tension to said back surface of said film.

The housing may further comprise a transition chamber between said moistening chamber and said drying chamber, said squeegee rollers being located in said transition chamber.

The lower squeegee roller may be coated with a napped layer, said upper squeegee roller having a relative smooth surface.

Said napped layer material may be formed by looped cotton filaments.

The upper squeegee roller may have an outer surface coated with Teflon (TM).

The upper squeegee roller may be adapted to be adjusted in a vertical direction relative to said emulsion carrying surface of the film.

The device may further include an axle mounted on said housing and carrying said upper squeegee roller, said housing having a lateral wall formed with a vertically projecting recess, said axle being adapted to move within said recess so that the position of the upper squeegee roller can be adjusted in the vertical direction.

The device may further comprise a pair of counterpositioned drying rollers arranged in contact with the film, said drying rollers being located in the transition chamber after the squeegee rollers in the advancing direction of the film.

At least one of said drying rollers may be coated with a textile material.

The drying rollers may have an upper idling drying roller and a power driven roller, said lower drying roller being rotated with a speed equal to said speed of rotation of said lower squeegee roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The sole FIGURE illustrates a sectional view through a device for processing a photographic film according to the invention.

DETAILED DESCRIPTION OF THE PREFERRED EMBODIMENT

The sole FIGURE illustrates a device for processing of photographic film having a housing generally designated as 1*a* and including a moistening chamber 1 and a drying chamber 2. A transition chamber or portion 3 of the device is located between chambers 1 and 2. A separating wall or partition 4 is provided for separating the moistening chamber 1 from the transition chamber 3. A wall 5 is formed in the housing 1*a* to separate the transition chamber 3 from the drying chamber. An opening 6 is formed in the partition 4 to receive a film 8 carrying an emulsion and advancing from the moistening chamber 1. An opening 7 to permit the advancing film to enter the drying chamber 2 is provided in the wall 5. It should be noted that if the wall 5 is a necessary part of the arrangement which serves to prevent moisture from entering the drying chamber 2, the wall 4 under certain circumstances may be omitted, at least the part thereof which extends above the opening 6. The film 8 is supported in the moistening chamber by means of counter-positioned transporting rollers 21 which are rotated in the direction indicated by arrow 21*a*. The film 8 is advanced by rollers 21 towards the transition chamber 3 where the film 8 carrying an emulsion is supported and fed further by a pair of squeegee rollers 10 and 11 in the transporting direction denoted by 9. The film 8 is further supported and advanced by a pair of counterpositioned drying rollers 12 and 13. The film 8 runs through both pairs of rollers within the transition chamber 3 in substantially horizontal direction. The upper squeegee roller 10 is mounted on an axle 14 which in turn is mounted in a vertically projecting longitudinal recess 15 formed in a lateral wall 16 of the housing 1*a*. The axle 14 carrying the upper roller 10 may be moved and adjusted in a vertical direction within the recess 15 towards the film 8 or away from the latter as shown by arrow 17. The idling upper squeegee roller 10 is fabricated from a relatively hard material such as for example having approximately 3 to 5 kilo ponds of weight per 1 m of roller length. Furthermore, the surface of the upper squeegee roller 10 is coated with a polymer, such as TEFLON (TM). The remaining rollers 11, 12 and 13 are coated with a napped layer. This napped layer may be formed as tubes of synthetic and/or cotton looped filament textile material which can be slipped over the rollers.

Both lower rollers 11 and 13 of pairs of squeegee rollers and drying rollers have drives which are advantageously coupled to one another so that these rollers are rotated in one direction and at the same speed. The upper rollers 10 and 12 engage with and are entrained by the emulsion layer 20 of the film 8. The speed of rotation of rollers 11 and 13 exceeds the speed of rotation of rollers 21 located in the moistening chamber 1.

In operation, the film 8 is fed from the moistening chamber 1 to the transition chamber 3 where it is passed between squeegee rollers 10 and 11 and then advanced between the drying rollers 12 and 13 and to the drying chamber 2 where it is further advanced between rollers 25 and 26 for final drying. The film 8 is squeegeed between rollers 10 and 11 so that about 30% of the surface water is removed from the film. Due to the surface tension of water the residual water still remaining after the squeegee operation tends to contract to form relatively large drops on the surface of the film 8. These drops, should the film enter the drying chamber and be dried therein with the drops in place, would form stains on the surface of the film.

In order to avoid this problem the pair of drying rollers 12 and 13 is provided in the transition chamber which serves to remove the aforementioned drops. The remaining moisture, respectively any remaining even small water drops, can be dried in the drying chamber 2 in a relatively short path.

By having the speed of the rollers 11 and 13 exceed the speed of rotation of rollers 21, a certain tension is applied to the film 8 with reference to the rollers 21 in the chamber 1. This assures a straight-line guidance of even a very extended length of film, for example of photo paper rolls having a length of more than 80 m. The tension of the film 8 will be applied in the device of the invention only to the insensitive back surface of the film contacting the rollers 11 and 13. If this tension becomes too large, the driven rollers may easily slip relative to the back side of the film, especially due to the fact that their surfaces are covered with a textile or nap material.

The upper gravity-weighted roller 10 may easily assembled in the device because in the arrangement according to the invention any pressure or spring elements may be omitted. Furthermore, the roller 10 may be easily changed for another one in dependence upon the various emulsions and the weight required to be used with them. The coating of roller 10 with TEFLON (TM) serves particularly to protect the emulsion layer 20 of the film against damage.

It will be understood that each of the elements described above, or two or more together, may also find a useful application in other types of devices for processing a photographic film differing from the types described above.

While the invention has been illustrated and described as embodied in a device for processing a photographic film, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for processing photographic film of relatively large width and having an emulsion carrying surface and a back surface, comprising a housing including a moistening chamber and a drying chamber; transporting means located in said moistening chamber and adapted to advance said film toward said drying chamber, said transporting means having a pair of transporting rollers rotated with a predetermined speed; and a pair of counterpositioned squeegee rollers positioned between said moistening chamber and said drying chamber and adapted to squeeze moisture from said film, said squeegee rollers including an upper idling squeegee roller contacting said emulsion carrying surface and a driven lower squeegee roller contacting said back surface of the film, said lower squeegee roller having a speed of rotation exceeding said predetermined speed to apply a predetermined tension to said back surface of said film.

2. The device of claim 1, wherein said housing further comprises a transition chamber between said moistening chamber and said drying chamber, said squeegee rollers being located in said transition chamber.

3. The device of claim 2, wherein said lower squeegee roller has a napped outer surface, said upper squeegee roller having a relatively smooth surface.

4. The device of claim 3, wherein said outer surface is formed by a layer made of looped cotton filaments.

5. The device of claim 3, wherein said upper squeegee roller has an outer surface coated with Teflon.

6. The device of claim 5, wherein said upper squeegee roller is adapted to be adjusted in a vertical direction relative to said emulsion-carrying surface of the film.

7. The device of claim 6, further including an axle mounted on said housing and carrying said upper squeegee roller, said housing having a lateral wall formed with a vertically extending recess, said axle being adapted to freely move within and lengthwise or said recess so that the position of said upper squeegee roller can be adjusted in said vertical direction.

8. The device of claim 7, further comprising a pair of counterpositioned drying rollers arranged in contact with said film, said drying rollers being located in said transition chamber after said squeegee rollers in the advancing direction of said film.

9. The device of claim 8 wherein at least one of said drying rollers is covered with a textile material.

10. The device of claim 9, wherein said drying rollers include an upper idling drying roller and a lower driven roller, said lower drying roller being rotated with a speed equal to said speed of rotation of said lower squeegee roller.

* * * * *